US007549252B2

(12) United States Patent
Vaughn

(10) Patent No.: US 7,549,252 B2
(45) Date of Patent: Jun. 23, 2009

(54) ENTRANCEWAY BARRIER APPARATUS

(76) Inventor: Andre B Vaughn, 15292 SW. 104 St., No. 11-33, Miami, FL (US) 33196

( * ) Notice: Subject to any disclaimer, the term of this patent is extended or adjusted under 35 U.S.C. 154(b) by 357 days.

(21) Appl. No.: 11/420,459

(22) Filed: May 25, 2006

(65) Prior Publication Data

US 2007/0271852 A1 Nov. 29, 2007

(51) Int. Cl.
*E06B 7/18* (2006.01)

(52) U.S. Cl. ..... 49/466; 49/465

(58) Field of Classification Search ..... 49/55, 49/463, 464, 465, 466
See application file for complete search history.

(56) References Cited

U.S. PATENT DOCUMENTS 1,849,024 A * 3/1932 McKee ..... 160/216
2,756,469 A * 7/1956 Cattermole et al. ..... 49/55
3,796,010 A * 3/1974 Carlson ..... 49/477.1
3,861,081 A * 1/1975 Maskell ..... 49/70
4,682,443 A * 7/1987 Demo ..... 49/466
5,077,945 A * 1/1992 Koeniger ..... 52/169.14
5,528,859 A * 6/1996 Taylor et al. ..... 49/55
5,924,242 A * 7/1999 Macari et al. ..... 49/55
5,943,832 A * 8/1999 Russell ..... 52/202
6,427,396 B1 * 8/2002 Harrison ..... 52/202
6,449,901 B1 * 9/2002 Gibree et al. ..... 49/57
6,591,553 B1 * 7/2003 Vaughn ..... 49/466
2002/0104275 A1 * 8/2002 Harrison ..... 52/202

* cited by examiner

*Primary Examiner*—Jerry Redman
(74) *Attorney, Agent, or Firm*—Patwrite LLC; Mark David Torche

(57) ABSTRACT

An entranceway barrier comprises two telescoping L-shaped frame assemblies having a ratcheting locking system that allows the barrier to be quickly inserted in a doorway. A self-locking ratchet mechanism allows the barrier to move outward exerting a securing force against a frame gasket placed in a doorway until the ratchet is manually released. A severable panel slides into a channel and is secured with a gasket channel seal to provide flood protection. Another embodiment comprises two telescoping C-shaped frame assemblies with two panel sections that slide adjacent to each other to provide adjustability.

3 Claims, 8 Drawing Sheets

ENTRANCEWAY BARRIER APPARATUS

BACKGROUND OF THE INVENTION

Humans have sought refuge from the elements since the beginning of history. Caves and trees no doubt provided shelter from weather, but in time hut building, sun bricks and wooden houses became common. Due to advances in modern home building, our structures are relatively safe refuges from the elements, but flooding is still a major issue in many areas. Often some of the most desirable properties are located along waterways and oceans which increase the danger of flooding. The damage sustained to buildings can be extensive even when the water is only a few inches above the doorway. In the past, people have attempted to use sandbags or other solutions to prevent flood waters from damaging their structures. While this can provide some measure of protection, it is laborious to use and often makes cleanup more difficult.

One of the easiest ways for flood water to gain entry into a structure is through the doorway since it is an opening basically at ground level or at least a low point compared to other opening such as windows. Solutions to this problem have been proposed such as U.S. Pat. No. 3,861,081 to Maskell dated Jan. 21, 1975 which provides for a flood barrier that is bolted or screwed across a doorway to prevent water from entering. Although this helps prevent water damage, it is not easily installed and requires permanent mounting brackets be installed in the protected structure.

Another solution is disclosed in U.S. Pat. No. 5,077,945 to Koeniger dated Jan. 7, 1992 which provides a removable door mounted barrier that inflates to hold it securely in place and then deflates when not in use. Although this eliminates the need for permanent mounting hardware, one would need to purchase different size devices in order to use with doors of substantially differing sizes.

There remains a need for an easy to install easily adjustable entranceway barrier that overcomes the limitations of the prior art.

SUMMARY OF THE INVENTION

An entranceway barrier comprises two telescoping L-shaped frame assemblies having a ratcheting locking system that allows the barrier to be quickly inserted in a doorway. A self-locking ratchet mechanism allows the barrier to move outward exerting a securing force against a frame gasket placed in a doorway until the ratchet is manually released. A severable panel slides into a channel and is secured with a gasket channel seal to provide flood protection. Another embodiment comprises two telescoping C-shaped frame assemblies with two panel sections that slide adjacent to each other to provide adjustability.

Other features and advantages of the instant invention will become apparent from the following description of the invention which refers to the accompanying drawings.

DETAILED DESCRIPTION OF THE INVENTION

Figure 1:
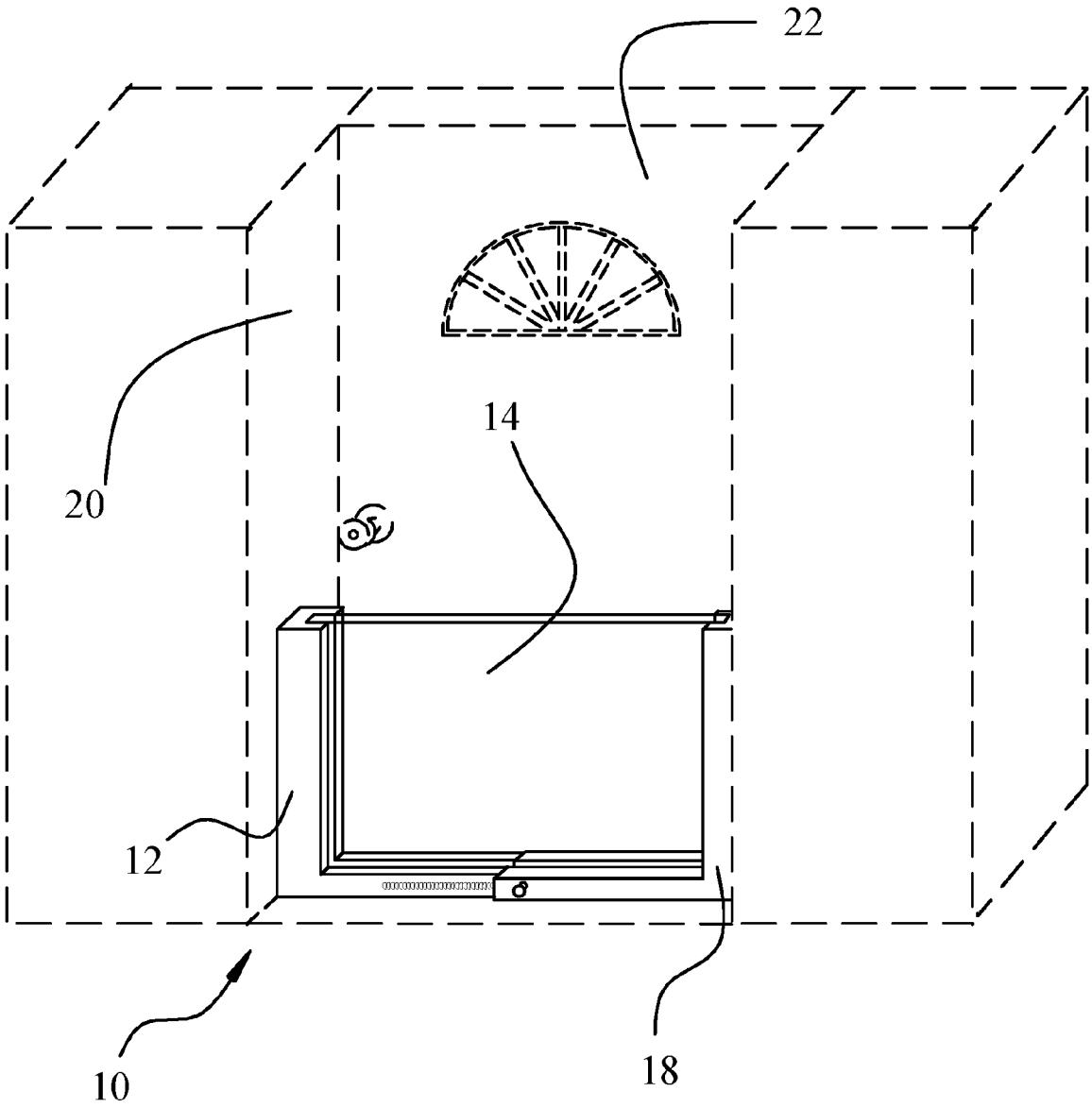
FIG. 1 is a perspective view of an embodiment according to the present invention.

Applicant incorporates by reference U.S. Pat. No. 6,591,553: Entranceway Barrier Apparatus issued to Andre B. Vaughn, to describe an entranceway barrier that fits in a doorway to provide protection against flooding, and need not be fully described in detail herein.

Reference is now made to the drawings in which reference numerals refer to like elements.

With reference to FIG. 1, an entranceway barrier is shown generally as 10 and comprises two frame assemblies 12 and 18 respectively. Entranceway barrier 10 fits within a lower portion of doorway 20 to prevent the egress of water in a structure through a door 22. A panel 14 is cut to size by a user once entranceway barrier 10 is adjusted to fit within doorway 20. A ratcheting mechanism 30 or 80 (FIGS. 3 and 8 respectively) allows for quick positioning in doorway 20.

Figure 2:
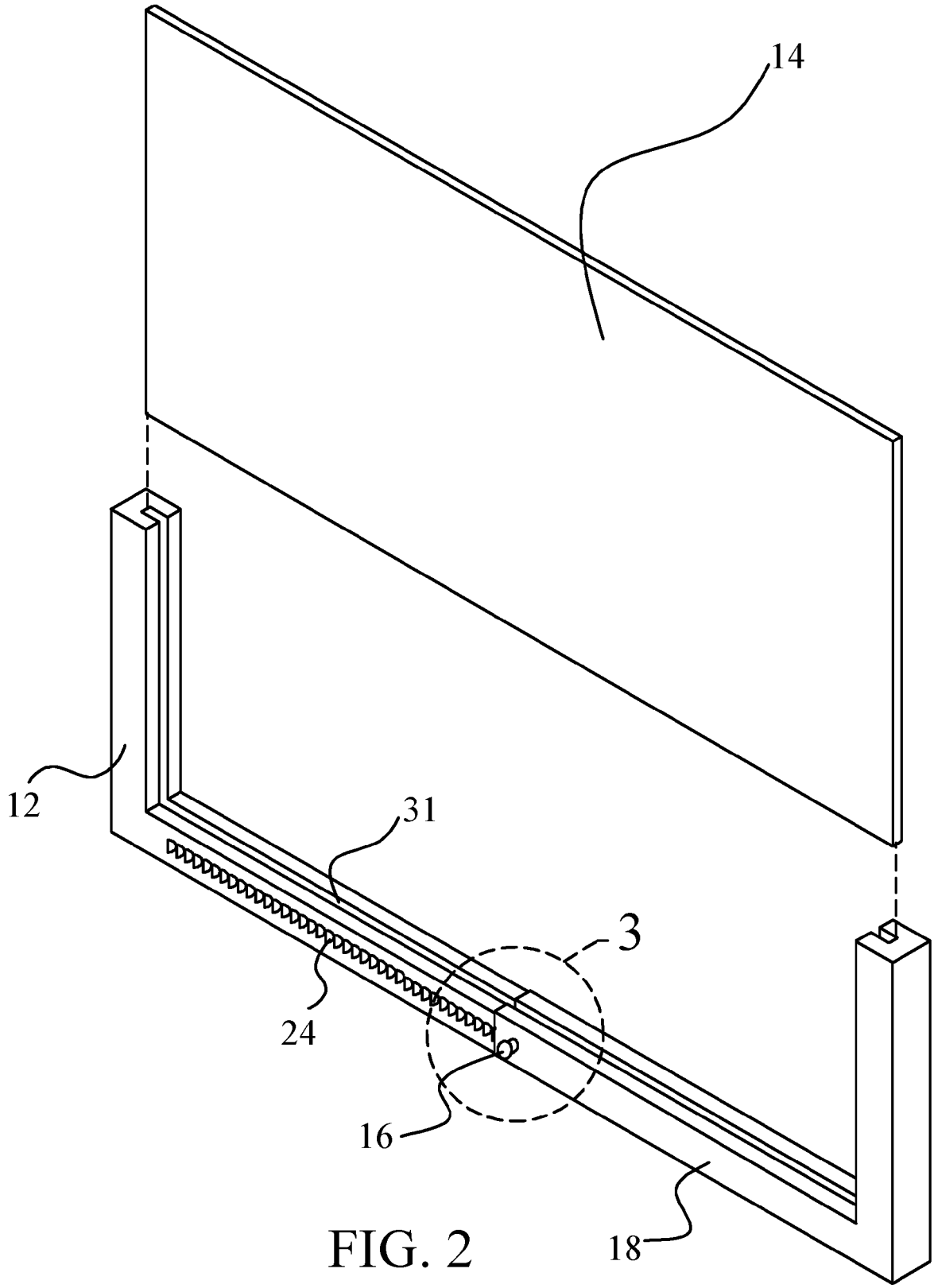
FIG. 2 is a perspective view of an embodiment according to the present invention.
Figure 3:
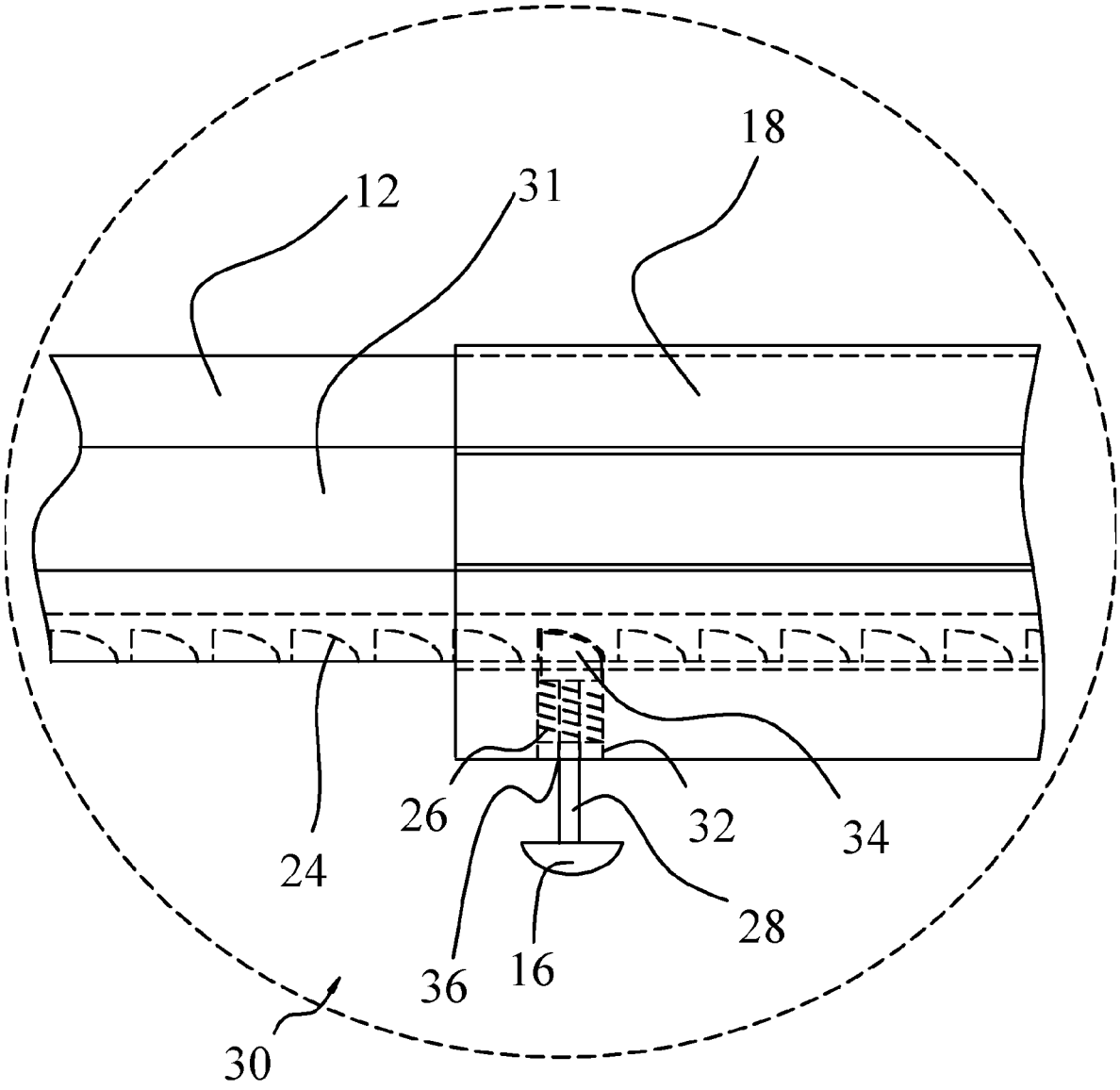
FIG. 3 is a detailed view of a section of the barrier of FIG. 2.
Figure 4:
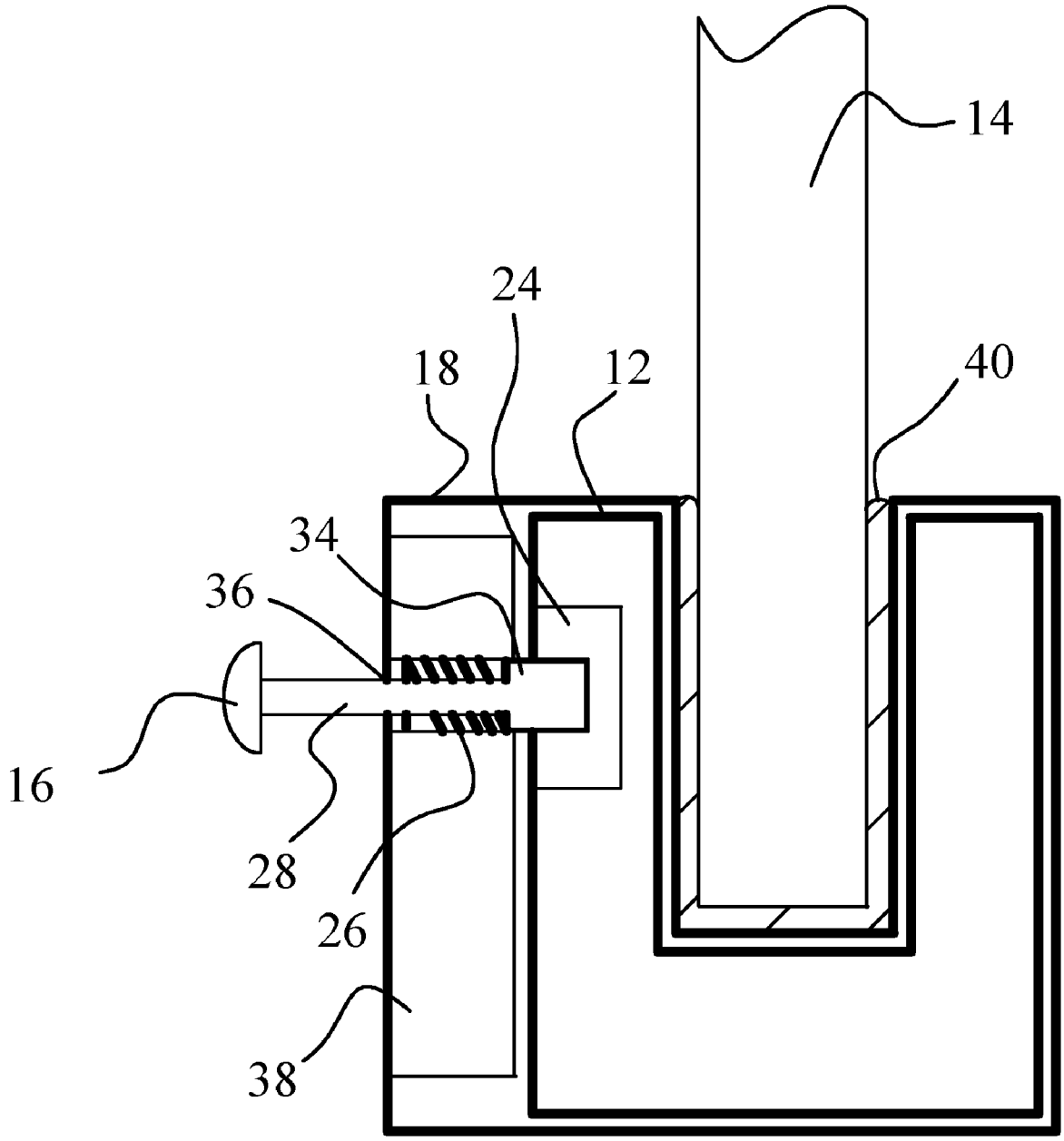
FIG. 4 is a cross-sectional view of a ratcheting device according to an embodiment of the present invention.

FIGS. 2, 3 and 4 show an embodiment of the entranceway barrier 10. A first frame assembly 18 telescopically slides over a second frame assembly 12 allowing entranceway barrier 10 to adjust in size to fit different size doorways 20 (FIG. 1). First and second frame assemblies 12 and 18 each have a vertical portion and a horizontal portion and when assembled form a U-shaped assembly. A ratcheting mechanism 30 comprises a ratchet engagement member 34 disposed on a pin 28 with a release cap 16. Pin 28 fits through hole 36 in the horizontal portion of first frame assembly 18. A spring 26 biases ratchet engagement member 34 against a plurality of ratchet engagement openings 24 located along the horizontal portion of second frame assembly 12. A retainer space 32 is formed within first frame assembly 18 to hold spring 26 against ratchet engagement member 34. Release cap 16 is used to disengage ratchet engagement member 34 from ratchet engagement openings 24 when removal of entranceway barrier 10 is desired.

Panel 14 fits into panel channel 31 disposed within the interior perimeter of first and second frame assemblies 12 and 18 and is sealed with a panel gasket 40 that prevents water from seeping past panel 14. Panel 14 may be made of plastic and may be pre-scored to facilitate trimming to fit entranceway barrier 10 (FIG. 1) once placed in doorway 20 (FIG. 1) as is known in the art. Alternatively, parallel lines may be printed on panel 14 to help a user accurately trim panel to fit. A utility knife or scissors may be used to trim panel 14 to size. Panel 14 may be made translucent or even clear or it may be opaque. Any suitable material may be used to fabricate panel 14 as long as it is user trimmable and water resistant. Additionally, a locking screw (not shown) may be provided to securely lock said entranceway barrier 10 in place after fitting to said doorway 20 (FIG. 1) as is known in the art.

Figure 5:
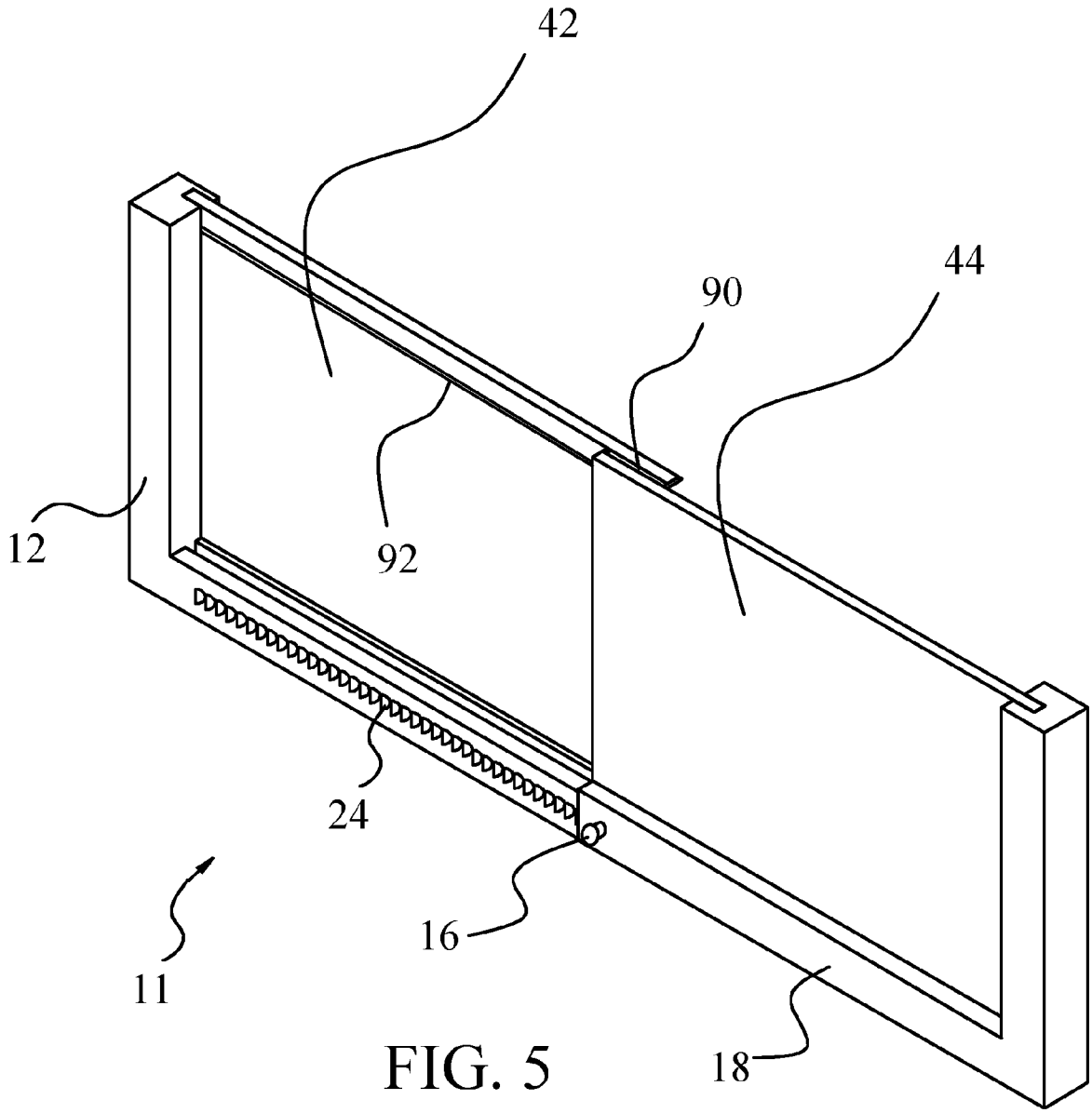
FIG. 5 is a perspective view of another embodiment according to the present invention.

Now referring to FIG. 5, an embodiment of an embodiment of an entranceway barrier 11 with like reference designators referred to earlier not be discussed in detail. In this embodiment of entranceway barrier 11, two panels 42 and 44 are mounted within frames 12 and 18 and slide past each other as entranceway barrier 11 fits within doorway 20 (FIG. 1). A panel seal 90 prevents water from leaking between panels 42 and 44. A panel guide 92 is attached to second panel 42 and slides within an interlocking panel guide (not shown) mounted on first panel 44 as is known in the art. A ratcheting adjustment mechanism 30 works as described above to allow entranceway barrier 11 to fit within various width doorways.

Figure 6:
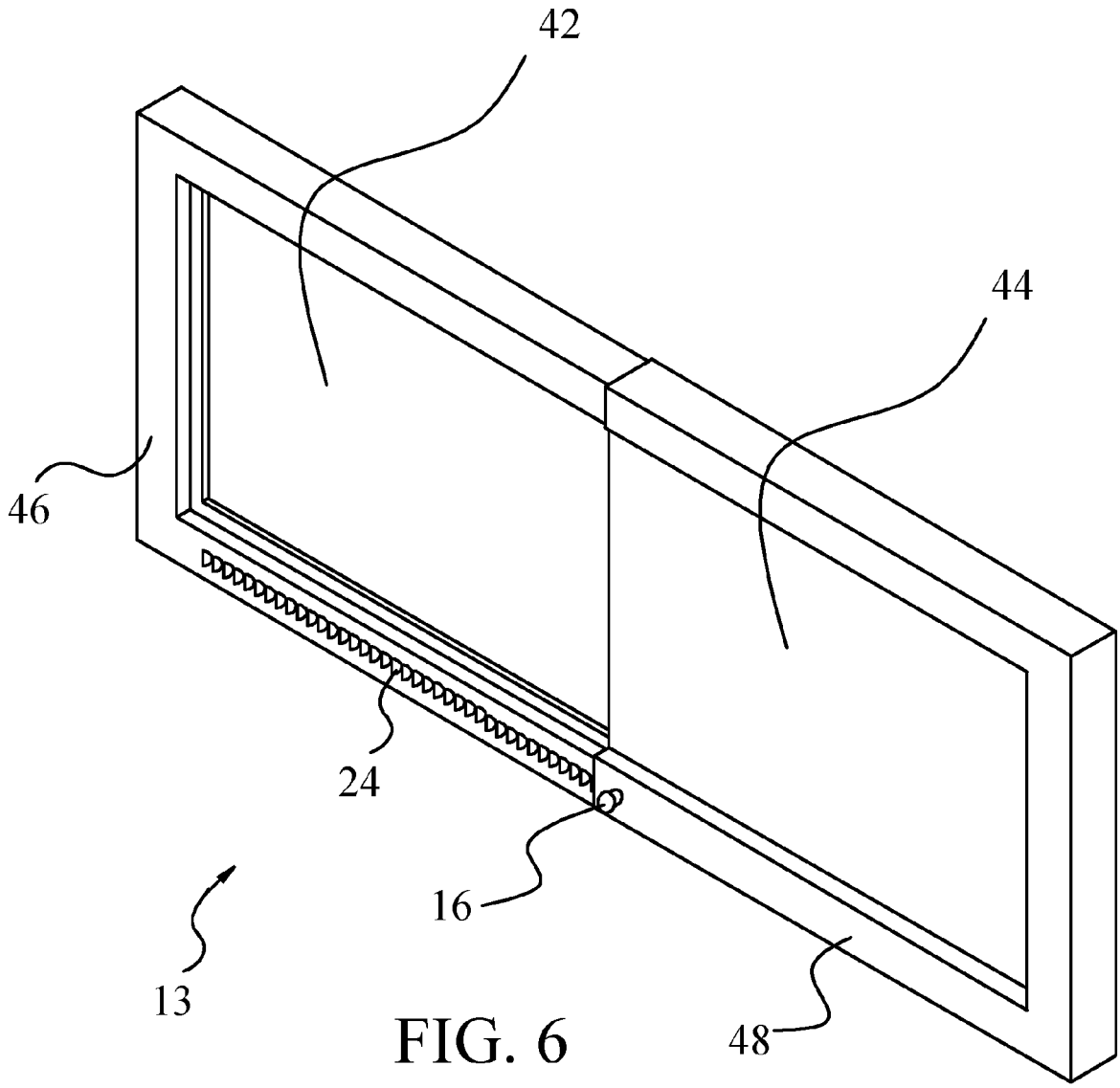
FIG. 6 is a perspective view of a further embodiment according to the present invention.

FIG. 6 shows another embodiment of an entranceway barrier shown generally as 13 and comprises a first frame assembly 48 and a second frame assembly 46 telescopically fitting within each other forming a box like structure. A first panel 44 and second panel 42 slide past each other as described above and a panel seal (not shown) keeps water from leaking through.

Figure 7:
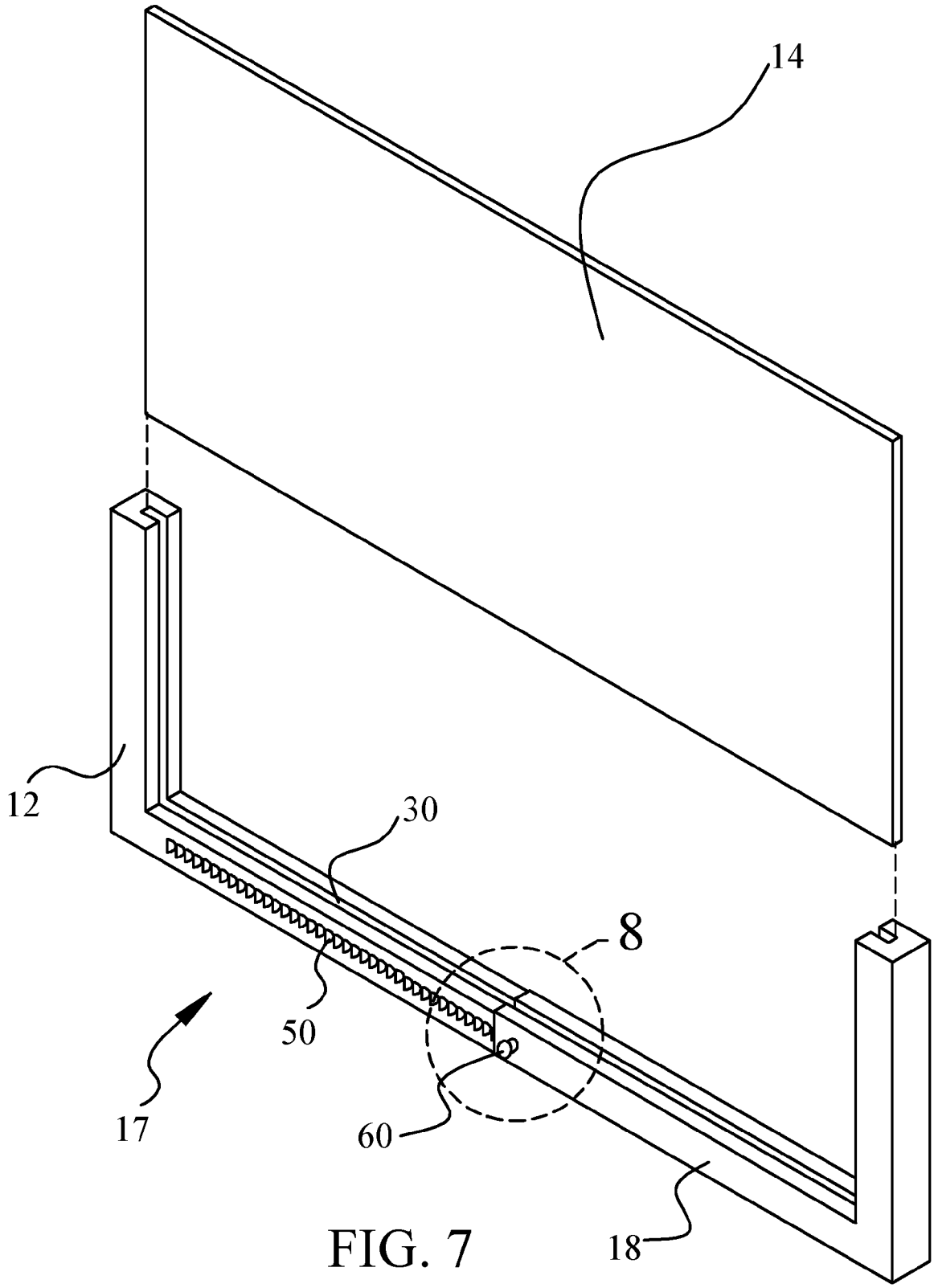
FIG. 7 is a perspective view of an embodiment according to the present invention.
Figure 8:
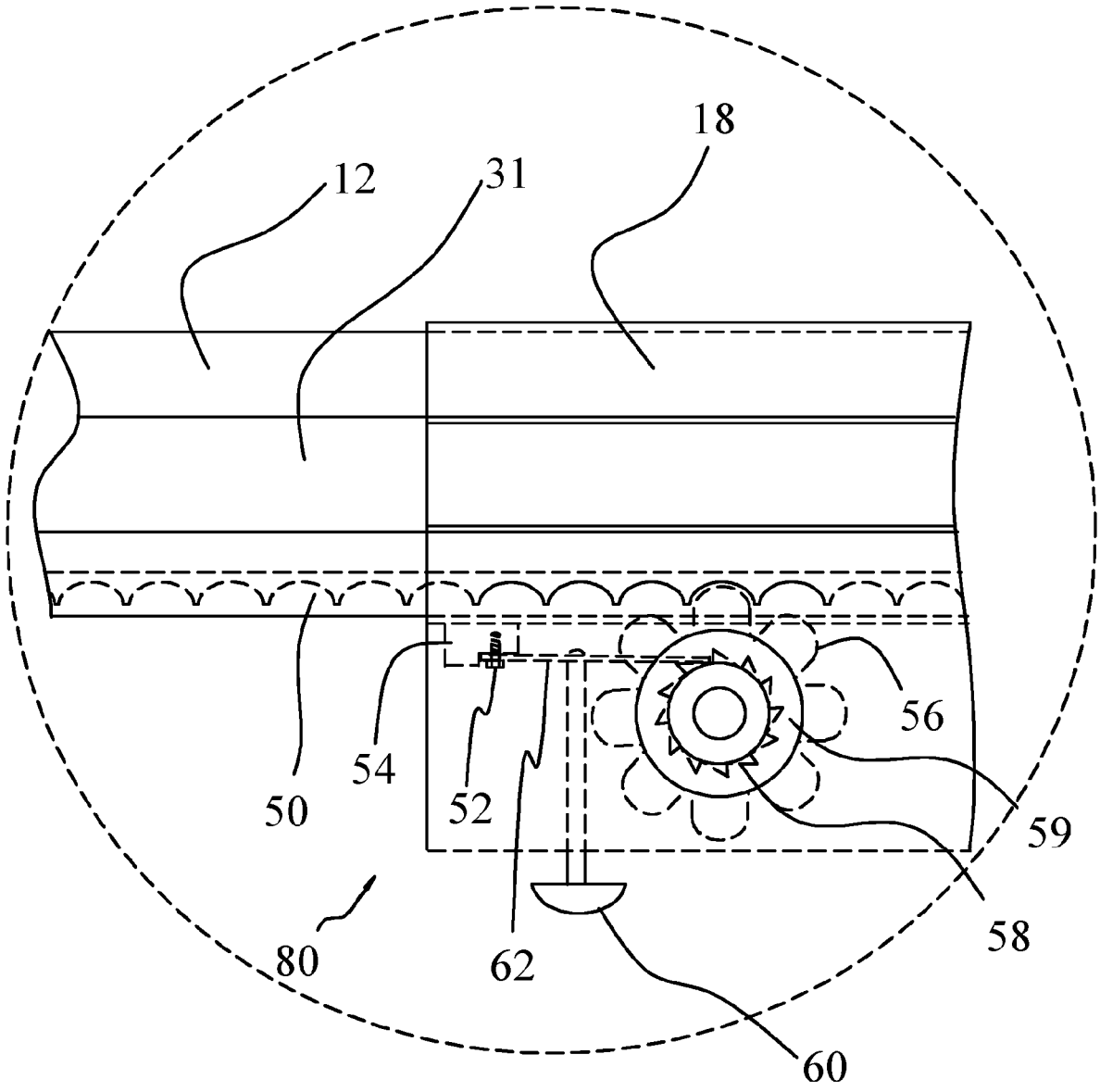
FIG. 8 is a detailed view of a section of the barrier of FIG. 7.

Now with reference to FIGS. 7 and 8, an entranceway barrier shown generally as 17 comprises a ratcheting mechanism 80 utilizing a ratchet wheel 59 with a plurality of ratchet engagement members 56 disposed along the periphery of ratchet wheel 59. A ratchet gear 58 works in conjunction with ratchet pawl 62 to adjust entranceway barrier 17 to fit within doorway 20 (FIG. 1). A cap 60 is connected to ratchet pawl 62 to release ratchet wheel 59 to remove entranceway barrier 17. Ratchet engagement members 56 engage with ratchet engagement openings 50 located on second frame assembly 12 as is known in the art. A mounting plate 54 utilizes a machine screw 52 to hole ratchet pawl 62 in place to provide the necessary biasing pressure.

Although the instant invention has been described in relation to particular embodiments thereof, many other variations and modifications and other uses will become apparent to those skilled in the art.

What is claimed is:

1. An entranceway barrier for blocking floodwaters from entering a structure through a doorway comprising:

a first frame assembly telescopically disposed within a second frame assembly wherein said second frame assembly fits within said first assembly;

a panel member;

said first and second frame assembly each having a vertically disposed upright section on an end thereof and a horizontally disposed section wherein when said first and second frame assemblies are telescopically joined along said horizontally disposed sections, they form a U-shaped assembly;

said first and second frame assembly each having a panel channel wherein said panel member is removably disposed therein;

a channel gasket disposed within said panel channel at least one ratcheting engagement member disposed on said first frame assembly along said horizontally disposed section;

a plurality of ratcheting engagement openings disposed on said second frame assembly along said horizontally disposed section;

a frame gasket for sealing between said entranceway barrier and said doorway; and a lock-down screw disposed along said first frame assembly horizontally disposed section whereby said first frame assembly is locked into position with respect to said second frame assembly after positioning said entranceway barrier in said doorway.

2. The entranceway barrier for blocking floodwaters from entering a structure through a doorway comprising:

a first frame assembly telescopically disposed within a second frame assembly wherein said second frame assembly fits within said first assembly:

a panel member:

said first and second frame assembly each having a vertically disposed upriciht section on an end thereof and a horizontally disposed section wherein when said first and second frame assemblies are telescopically joined along said horizontally disposed sections, they form a U-shaped assembly;

said first and second frame assembly each having a panel channel wherein said panel member is removeably disposed therein;

a rotating wheel for selectively positioning said first frame with respect to said second frame whereby said entranceway barrier is secured in said doorway:

said rotating wheel having with a plurality of engagement members along an outer diameter of said rotating wheel disposed within said first frame assembly along said horizontally disposed section;

a pawl to prevent said rotating wheel from rotating in an opposite direction;

a plurality of engagement member openings disposed along said second frame assembly along said horizontally disposed section;

a release mechanism for releasing said pawl;

a panel member sealing means for securing said panel member to said entranceway barrier to provide a water-tight seal between said panel member and said entranceway barrier: and a frame sealing means for securing said entranceway barrier to said doorway to provide a water-tight seal between said entranceway barrier and said doorway.

3. The entranceway barrier for blocking floodwaters from entering a structure through a doorway according to claim 2 wherein said ratchet engagement member includes a cap portion to manually release said ratchet engagement member.

* * * * *